US008769883B2

(12) United States Patent
Bazzarini et al.

(10) Patent No.: US 8,769,883 B2
(45) Date of Patent: Jul. 8, 2014

(54) EXPANSION JOINT FOR BUILDING WORKS

(71) Applicants: Stefano Bazzarini, San Pier d'Isonzo (IT); Loris Monti, Bologna (IT)

(72) Inventors: Stefano Bazzarini, San Pier d'Isonzo (IT); Loris Monti, Bologna (IT)

(73) Assignee: Joint S.r.l., Bologna (IT)

( * ) Notice: Subject to any disclaimer, the term of this patent is extended or adjusted under 35 U.S.C. 154(b) by 0 days.

(21) Appl. No.: 14/025,895

(22) Filed: Sep. 13, 2013

(65) Prior Publication Data

US 2014/0083036 A1 Mar. 27, 2014

(30) Foreign Application Priority Data

Sep. 21, 2012 (IT) ..... BO2012A0508

(51) Int. Cl.
*F21S 8/00* (2006.01)
*F21S 4/00* (2006.01)

(52) U.S. Cl.
USPC ..... 52/28; 52/396.04; 52/396.05; 362/153; 362/153.1

(58) Field of Classification Search
CPC ..... E04B 1/68; E04B 1/681; E04B 1/6804; E04B 1/6807; E04B 1/6815; E01D 19/065; E04F 15/02005
USPC ..... 52/28, 396.04, 396.05; 362/145, 147, 362/153, 153.1
See application file for complete search history.

(56) References Cited

U.S. PATENT DOCUMENTS

| | | | | |
|---|---|---|---|---|
| 4,819,136 | A * | 4/1989 | Ramsey | 362/495 |
| 4,901,495 | A * | 2/1990 | Gottschling | 52/396.05 |
| 5,430,627 | A * | 7/1995 | Nagano | 362/146 |
| 6,523,986 | B1 * | 2/2003 | Hoffmann | 362/576 |
| 6,606,827 | B1 * | 8/2003 | Hoffmann | 52/28 |
| 7,021,786 | B1 * | 4/2006 | Sandor, Sr. | 362/153 |
| D623,342 | S * | 9/2010 | Klu | D26/138 |
| 8,267,540 | B2 * | 9/2012 | Klu | 362/153 |
| 2002/0059764 | A1 * | 5/2002 | Schluter | 52/396.04 |
| 2006/0146531 | A1 * | 7/2006 | Reo et al. | 362/244 |
| 2007/0236918 | A1 * | 10/2007 | Lane et al. | 362/147 |
| 2010/0272510 | A1 * | 10/2010 | Mohajer | 404/13 |
| 2011/0110077 | A1 * | 5/2011 | Klus | 362/153 |

FOREIGN PATENT DOCUMENTS

| | | |
|---|---|---|
| DE | 103 01 162 | 12/2004 |
| DE | 10 2011 008898 | 7/2012 |

OTHER PUBLICATIONS

IT B020120508 Search Report and Written Opinion mailed Jun. 19, 2013, 5 pages—Italian, 3 pages—English.

* cited by examiner

*Primary Examiner* — Robert Canfield

(74) *Attorney, Agent, or Firm* — Andrew F. Young, Esq.; Lackenbach Siegel, LLP

(57) ABSTRACT

Described is an expansion joint (1) for building works comprising: a first and a second fastening flap (2, 3) rigidly connectable to corresponding structural elements (4, 5) and elongated in a longitudinal direction; an elastic connector (7) connected to the fastening flaps (2, 3) and interposed there for filling a space (6) between the structural elements (4, 5), and for allowing a relative movement of them; at least one profile (8) hooked to one of the fastening flaps (2, 3) from the side opposite the elastic connector (7), the profile (8) forming a channel elongated in the longitudinal direction; at least one illuminating element (9) positioned inside the channel.

12 Claims, 2 Drawing Sheets

EXPANSION JOINT FOR BUILDING WORKS

CROSS REFERENCE TO RELATED APPLICATION

This application relates to and claims priority from Italian Ser. No. BO2012S000508 filed on Sep. 21, 2012, the entire contents of which are incorporated herein by reference.

FIGURE SELECTED FOR PUBLICATION

FIG. 2

BACKGROUND OF THE INVENTION

1. Field of the Invention

The present invention relates to an expansion joint for building works. More specifically, the invention relates to an expansion joint for building works, designed for being inserted inside spaces (gaps) formed inside horizontal or vertical structural closing elements (forming floors or ceilings or walls).

2. Description of the Related Art

The expansion joints in the structures are detachment points inserted at predetermined distances (normally every 30 m) in relation to the type of material, for following the expansions and contractions which the materials undergo following seasonal heat variation phenomena.

The purpose of the expansion joint is to allow the maximum movement caused by the heat variations, settlement of some parts of the building or between building bodies built at different periods in time.

Various types of expansion joints are available on the market, classified according to their use in the vertical or horizontal structures or according to the types of material.

In general, an expansion joint for building works comprises:

a first and a second fastening flap rigidly connected to corresponding structural elements and elongated in a longitudinal direction;

an elastic connector connected to the fastening flaps and interposed there for filling (at least partially) the space (or gap) between the structural elements, so as to allow a relative movement of them.

The joints require quite complex processing and, with regard to the expansion joints applied to floors, are mounted on an existing screed or on a load-bearing structure at the time it was made.

However, a limitation of these joints is that they do not have further functions, other than the above-mentioned structural function.

Moreover, these joints, on view, constitute a discontinuity which, in certain contexts, penalizes the appearance of the element (floor, ceiling or wall) in which they are inserted.

Accordingly, there is a need for an improved expansion joint for building works

ASPECTS AND SUMMARY OF THE INVENTION

The aim of this invention is to provide an expansion joint for building works that overcomes the above mentioned disadvantages of the prior art.

More specifically, the aim of this invention is to provide a multi-purpose expansion joint which is aesthetically very pleasing.

These aims are fully achieved by the expansion joint according to the invention as characterized in the appended claims.

More specifically, the expansion joint according to this invention comprises (integrated therein) a channel forming a luminous groove.

More specifically, the expansion joint comprises at least one profile fastened (i.e. firmly connected, hooked) to one of the fastening flaps from the side opposite the elastic connector, the profile forming a channel elongated in the longitudinal direction, and at least one illuminating element positioned inside the channel.

The expansion joint also comprises two profiles forming luminous grooves, each hooked to a corresponding fastening flap, and positioned parallel to each other, from the opposite sides to the elastic connector.

It should be noted that this invention also provides a method for mounting an expansion joint.

The method comprises the following steps:

rigidly connecting a first and second fastening flap to a corresponding first and second structural element separated by a space, the fastening flaps and the space being elongated in a longitudinal direction;

interconnecting the fastening flaps by an elastic connector interposed in the space to allow a relative movement of the structural elements;

fastening (i.e. firmly connecting, or hooking) to at least one of the fastening flaps, from the side opposite the elastic connector, a profile forming a channel elongated in the longitudinal direction and containing an illuminating element.

Moreover, this invention provides an illuminating body for building works, comprising a profile elongated in a longitudinal direction, having a bottom wall and two side walls and forming a channel, and at least one illuminating element positioned inside the channel.

According to the invention, one of the side walls of the profile in the illuminating body comprises coupling means, for fixing the profile to a fastening flap of an expansion joint designed to connect two structural elements, the profile being connectable to the expansion joint outside the space.

The illuminating body has the advantage that it can be mounted quickly and easily, without the need for any specific processing and without the need to make catches or other housings in the structural element in which the luminous groove is to be made.

The above and other aspects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
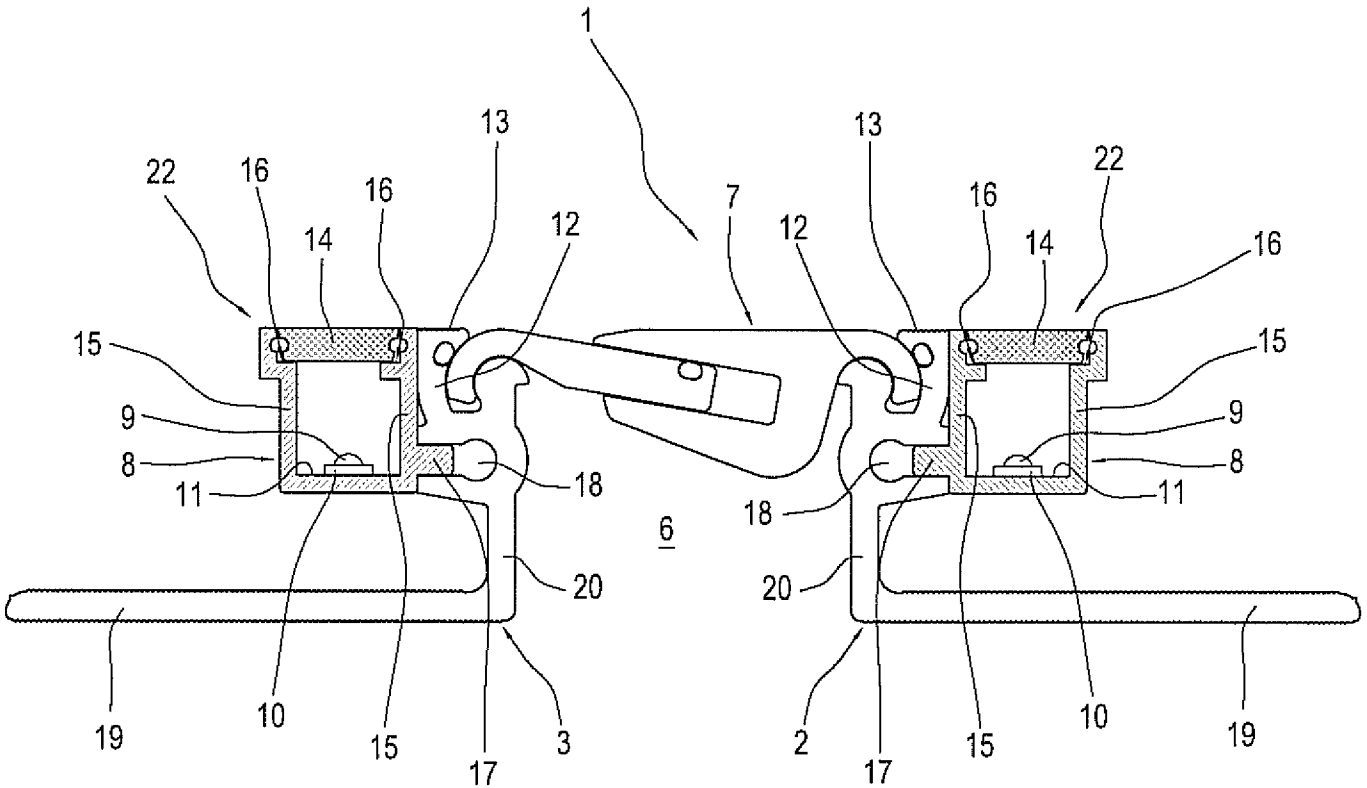
FIG. 1 is a cross section of the expansion joint according to the invention.
Figure 2:
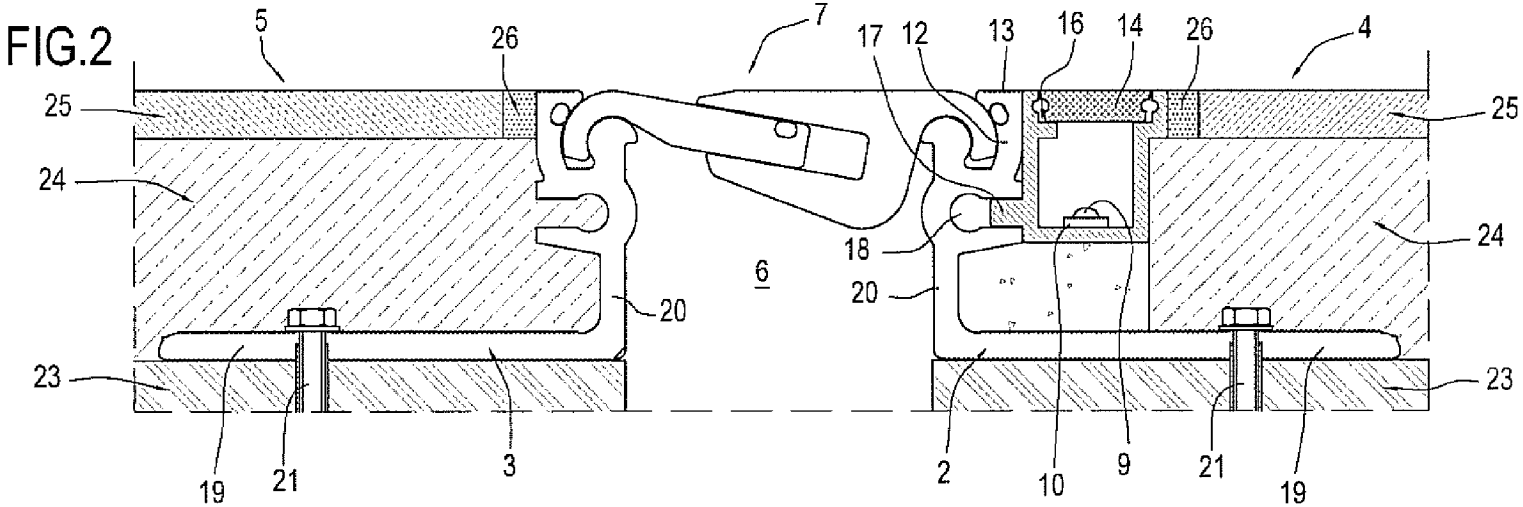
FIG. 2 illustrates the joint of FIG. 1 mounted in a floor.
Figure 3:
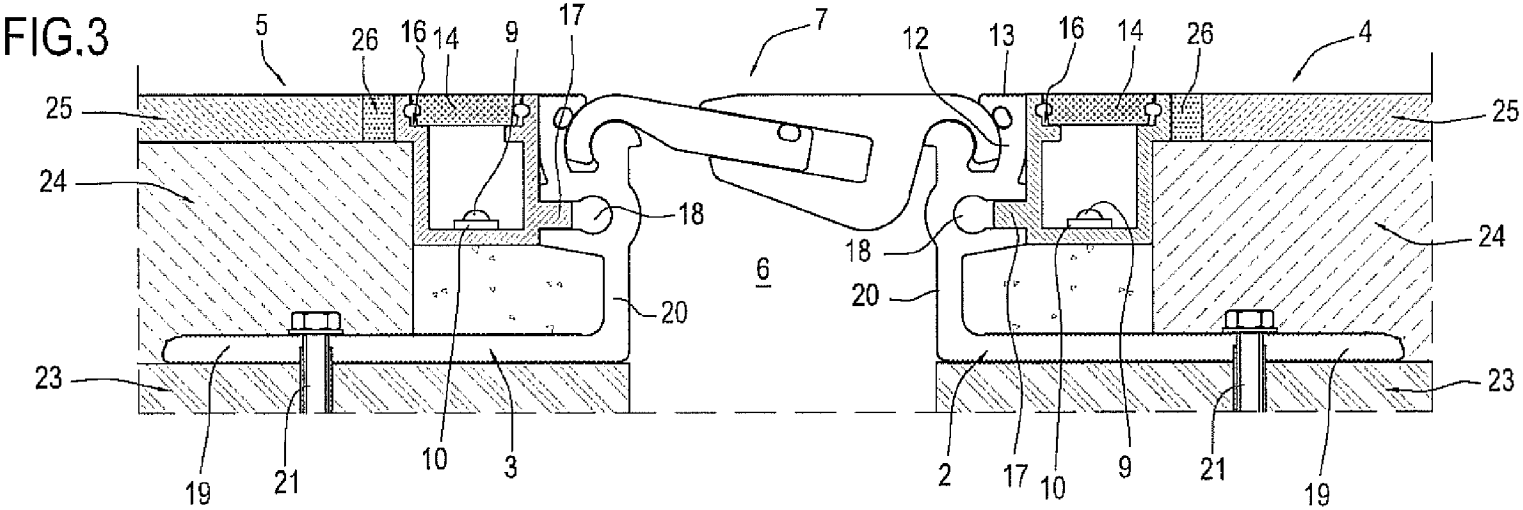
FIG. 3 illustrates the joint of FIG. 2 in an alternative embodiment.

Reference will now be made in detail to embodiments of the invention. Wherever possible, same or similar reference numerals are used in the drawings and the description to refer to the same or like parts or steps. The drawings are in simplified form and are not to precise scale. The word 'couple' and similar terms do not necessarily denote direct and immediate connections, but also include connections through intermediate elements or devices. For purposes of convenience and clarity only, directional (up/down, etc.) or motional (forward/back, etc.) terms may be used with respect to the drawings. These and similar directional terms should not be construed to limit the scope in any manner. It will also be understood that other embodiments may be utilized without departing from the scope of the present invention, and that the detailed description is not to be taken in a limiting sense, and that elements may be differently positioned, or otherwise noted as in the appended claims without requirements of the written description being required thereto.

Various operations may be described as multiple discrete operations in turn, in a manner that may be helpful in understanding embodiments of the present invention; however, the order of description should not be construed to imply that these operations are order dependent.

The numeral 1 in the accompanying drawings denotes an expansion joint according to this invention.

The joint 1 comprises a first fastening flap 2 and a second fastening flap 3.

The fastening flaps 2, 3 are elongated in a longitudinal direction.

The first fastening flap 2 is designed for being rigidly connected to a first structural element 4; the second fastening flap 3 is designed for being rigidly connected to a second structural element 5.

The structural elements 4 and 5 constitute two portions of a structural element (more specifically, a horizontal or vertical structural closing element, that is, a floor or a ceiling or a wall) interrupted along a longitudinal direction.

This interruption forms a space 6 (that is, a gap) between the first and second structural elements 4, 5.

It should be noted that the space or gap is, in turn, elongated along the longitudinal direction.

The numeral 7 denotes an elastic connector connected to the fastening flaps 2, 3.

The elastic connector 7 is interposed between the fastening flaps 2, 3 to allow a relative movement of the structural elements 4, 5 or to compensate any volumetric variations of them.

Moreover, the function of the elastic connector 7 is to partially fill the space 6 (gap), forming a substantially continuous outer surface, to connect the two structural elements 4, 5 in their area of interruption.

In the example illustrated, the elastic connector 7 comprises two coupled connecting elements for sliding one (male) inside the other (female).

However, the elastic connector 7 comprises a layer of elastic material (for example, an elastomer) suitably shaped (according to known technology in the expansion joints sector), or any other prior art configuration in the expansion joints sector.

According to the invention, the expansion joint 1 also comprises at least one profile 8 hooked (fixed) to the fastening flaps 2, 3.

The profile 8 is coupled to the fastening flap 2 or 3 outside the space 6.

For this reason, the profile 8 is coupled to the fastening flap 2 or 3 from the side opposite the elastic connector 7; in effect, preferably, at least one portion of the fastening flap 2 or 3 is interposed between the elastic connector 7 and the profile 8.

The profile 8 forms a channel elongated in the longitudinal direction and houses at least one illuminating element 9 positioned inside the channel.

For this reason, the joint 1 forms a luminous groove elongated along the longitudinal direction; the luminous groove runs parallel to the elastic connector 7 and is positioned alongside it.

It should be noted that the joint 1 also comprises two profiles 8, each forming a relative luminous groove and connected to a corresponding fastening flap; consequently, the two profiles 8 are positioned on opposite sides to the elastic connector 7.

Preferably, the joint 1 comprises a plurality of illuminating elements 9, preferably consisting of LEDs.

Alternatively, the illuminating element 9 could comprise a neon or another light source.

Preferably, the joint 1 comprises a base 10, resting on a bottom wall 11 of the profile; the illuminating bodies 9 are rested on the base 10.

The fastening flaps 2, 3 are connected to the elastic connector 7 in such a way as to form a flat, planar surface, flush with an outer surface of the structural elements 4, 5.

If the structural elements 4, 5 are part of a floor, the flat outer surface is treadable.

Preferably, each of the fastening flaps 2, 3 has a separator 12 forming a surface 13 which, when the joint 1 is mounted, is positioned flush with the outer surface of the structural elements 4, 5 and of the elastic connector 7.

According to the invention, the profile 8 is connected to the fastening flap 2 or 3 in such a way as to form a flat surface flush with the flat surface of the flaps (if the structural elements 4, 5 are part of a floor, the flat outer surface of the profile 8 is treadable).

Preferably, the joint 1 comprises a transparent covering element 14 (that is, designed to let the light pass) connected to the profile 8 to close it above (that is, to close an opening opposite the bottom wall 11).

It should be noted that, in addition to the bottom wall 11, the profile 8 has two side walls 15, for forming the open channel.

The joint 8 is connected to the respective fastening flap in such a way that the opening of the channel faces the outside of the structural elements 4, 5.

The covering element 14 is coupled to the profile 8 for closing the opening, in such a way as to form an outer surface positioned flush with the outer surface of the structural elements 4, 5 (and with the outer surfaces 13 of the fastening flaps 2, 3 and with the outer surface of the elastic connector 7).

Preferably, the profile 8 has two undercuts 16 forming a housing positioned close to the opening facing towards the outside (that is, an upper opening, if the joint is coupled to a floor) of the profile 8.

The housing is shaped to receive the covering element 14.

The covering element 14 is preferably made from plastic material (for example, Plexiglas).

Preferably, the covering element 14 has inclined side walls in such a way as to give the covering element a trapezoidal cross-section.

Moreover, preferably, the side walls of the covering element form respective recesses. Preferably, in addition or alternatively, the ends of the side walls 15 of the profile 8 (the ends forming the housing) define respective recesses.

The tapered shape of the covering element 14 facilitates the mounting of the covering element 14 on the profile 8.

The presence of the recesses facilitates the fixing of the covering element 14 on the profile 8, allowing the introduction of silicon or other fixing fluids in the gaps formed by the recesses, interposed between the side walls of the covering element 14 and the ends of the side walls 15 of the profile 8.

Preferably, one of the side walls 15 of the profile 8 and a corresponding side wall of the respective fastening flap are near to one another.

Preferably, the side wall 15 of the profile 8 and the corresponding side wall of the respective fastening flap near to one another are shaped to match one another to form a fitting.

Preferably, the side wall 15 of the profile 8 has a protrusion 17 elongated longitudinally; preferably, a side wall of the fastening flap forms a corresponding longitudinal groove 18.

The protrusion 17 of the profile 8 and the groove 18 of the fastening flap are shaped in such a way that the protrusion 17 is inserted in the groove 18, when the profile 8 is hooked to the fastening flap.

This coupling has certain advantages.

First of all, it gives mechanical strength to the profile 8; this is especially important when the joint 1 is used in a floor, which is walked or driven on (by persons or vehicles, such as automobiles or trolleys); in effect, this solution allows the profile 8 to be driven on by heavy vehicles (for example, trolleys or automobiles).

Another advantage of this clip coupling is that the profile can be slidably hooked to the fastening flap, allowing an adjustment of the longitudinal position of the profile 8 relative to the fastening flap, before a final fixing of the profile 8 to the fastening flap.

With regard to the fastening flaps 2, 3, they preferably have the shape described below.

Preferably, each of the fastening flaps 2, 3 has an L-shaped cross-section (and it is substantially a profile).

More specifically, each of the fastening flaps 2, 3 has a first side 19 (long) and a second side 20 (short); the first and the second sides are preferably perpendicular to each other.

The first side 19 (long) can be anchored to the structural element 4, 5, to be positioned parallel to a surface formed by the structural element; this anchoring is obtained, for example, by screws 21.

The second side 20 (short) has an end connected to the elastic connector 7.

Preferably, the profile 8 is hooked to the second side 20 (short) of the relative fastening flap 2 or 3.

It should be noted that the second side 20 of the fastening flap has two faces:

a first face faces towards the other fastening flap, that is, towards the empty space 6 (gap) between the structural elements 4, 5 and delimits a portion of the space 6;

a second face faces in the opposite direction, that is, towards the side opposite the gap.

The profile 8 is connected to the second face.

Preferably, an outer surface of one of the side walls 15 of the profile 8 is in contact with a corresponding surface (of the second face) of the second side 20 of the fastening flap 2 or 3.

Preferably, the joint 1 comprises adhesive fixing means interposed between the side wall 15 of the profile 8 and a corresponding side wall of the fastening flap, defined by the second side 20.

More specifically, the adhesive fixing means are interposed between the outer surface of the side wall 15 of the profile 8 and the corresponding surface (of the second face) of the second side 19 of the fastening flap 2 or 3.

It should be noted that this invention also provides an illuminating body 22 for building works.

The illuminating body 22 for building works comprises:

the profile 8;

the at least one illuminating element 9 positioned inside the channel formed by the profile.

The features of the illuminating body 22 are those described above; consequently, the illuminating body 22 is designed for being permanently (and rigidly) connected to one of the fastening flaps 2, 3 of the expansion joint 1.

For this reason, one of the side walls 15 of the profile 8 comprises coupling means for fixing the profile to a fastening flap 2, 3 of the expansion joint 1 (designed to connect the structural elements 4, 5).

The illuminating body 22 is shaped in such a way that the profile 8 can be connected to the fastening flap 2, 3 outside the space 6 (gap).

Preferably, the at least one side wall 15 has the protrusion 17 elongated longitudinally, slidably insertable in the corresponding longitudinal groove 18 of one of the side walls 15 of the fastening flap 2 or 3.

Moreover, the illuminating body 22 comprises the transparent covering element 14 inserted in a housing formed by the profile 8 close to an opening (upper).

This invention also provides a method for mounting an expansion joint 1 for building works.

The joint 1 is mounted to make an elastic joint between two structural elements 4, 5 of a building structure (for example, a floor or ceiling or wall) interrupted and separated by a space 6 elongated longitudinally.

If these structural elements 4, 5 form part of a floor, the structural elements 4, 5 comprise a support structure 23, on which a layer of bedding mortar is formed (that is, a screed 24 also known as "concrete topping").

A floor finishing layer 25 is laid above the screed 24.

In light of this, the method for mounting the expansion joint 1 comprises the following steps:

rigidly connecting the first fastening flap 2 and a second fastening flap 3 to the first structural element 4 and to the second structural element 5, respectively;

interconnecting the fastening flaps 2, 3 by an elastic connector 7 positioned in the space 6 separating the structural elements 4, 5, to allow a relative movement of the structural elements;

hooking to at least one of the fastening flaps 2, 3, from the side opposite the elastic connector 7, a profile 8 forming a channel elongated in the longitudinal direction and containing an illuminating element 9 (making a luminous grove elongated longitudinally parallel to the elastic connector 7).

Preferably, the hooking comprises a fitting of portions shaped to match of a side wall 15 of the profile 8 and a corresponding side wall of the fastening flap (as described above).

Preferably, there is also a step of gluing two corresponding faces of the profile 8 and a corresponding side wall of the fastening flap.

In the embodiment illustrated, the bottom wall 11 of the profile is distanced from the first side 19 (long) of the corresponding fastening flap 2 or 3.

In light of this, the method preferably comprises a step for filling the space between the bottom wall 11 of the profile 8 and the first side 19 (long) of the fastening flap 2 or 3 with epoxy resin (or another filler material designed to give structural strength to the profile 8, for allowing heavy loads to transit on the profile 8 without damaging the joint 1.

For this reason, there is a step for filling with epoxy resin a defined area between the profile 8 and a wall of the fastening flap 2 or 3 positioned transversely to another wall of the fastening flap 2 or 3, the other wall being hooked to the profile 8.

In an alternative embodiment, the bottom wall 11 of the profile 8 is in contact with (that is, it rests on) the first side 19 (long) of the corresponding fastening flap 2 or 3, either directly or by means of a supporting leg.

Preferably, between the profile 8 and the finishing layer 25 inserts 26 made of sealing material (for example, silicon), having elastic properties, are inserted; to protect the profile and the finishing layer 25.

Having described at least one of the preferred embodiments of the present invention with reference to the accompanying drawings, it will be apparent to those skills that the invention is not limited to those precise embodiments, and that various modifications and variations can be made in the presently disclosed system without departing from the scope or spirit of the invention. Thus, it is intended that the present disclosure cover modifications and variations of this disclosure provided they come within the scope of the appended claims and their equivalents.

What is claimed is:

1. An expansion joint (1) for building works, comprising:

a first and a second fastening flap (2, 3) rigidly connectable to corresponding structural elements (4, 5) and elongated in a longitudinal direction;

an elastic connector (7) connected to the fastening flaps (2, 3) and interposed there for filling a space (6) between the structural elements (4, 5), and for allowing a relative movement therebetween;

at least one profile (8) fastened to one of the fastening flaps (2, 3) from the side opposite the elastic connector (7), the profile (8) forming a channel elongated in the longitudinal direction; and at least one illuminating element (9) positioned inside the channel.

2. The expansion joint according to claim 1, wherein:

the fastening flaps (2, 3) and the elastic connector (7) form a flat surface;

the at least one profile (8) forms a flat surface flush with the flat surface of the flaps (2, 3) and of the connector (7).

3. The expansion joint according to claim 1, further comprising:

a transparent covering element (14) connected to the at least one profile (8) to close it above.

4. The expansion joint according to claim 3, wherein:

the profile (8) has two undercuts (16) forming a housing positioned close to an upper opening of the profile (8) and shaped to receive the covering element (14).

5. The expansion joint according to claim 1, wherein:

a side wall (15) of the at least one profile (8) and a corresponding side wall of the fastening flap (2, 3) are near to one another and shaped to match for forming a fitting.

6. The expansion joint according to claim 5, wherein:

the side wall (15) of the at least one profile (8) has a protrusion (17) elongated longitudinally, inserted in a corresponding longitudinal groove (18) of the side wall (15) of the fastening flap (2, 3).

7. The expansion joint according to claim 1, wherein:

each of the fastening flaps (2, 3) is a profile with an L-shaped cross-section having:

a long side (19) which can be anchored to the structural element (4, 5), to be positioned parallel to an outer surface formed by the structural element; and a second side (20) having an end connected to the elastic connector (7) and hooked to the profile (8).

8. The expansion joint according to claim 1, further comprising:

adhesive fixing means interposed between a side wall (15) of the at least one profile (8) and a corresponding side wall of the fastening flap (2 or 3).

9. An illuminating body (22) for building works, comprising:

a profile (8) elongated in a longitudinal direction, having a bottom wall (11) and two side walls (15) and forming a channel;

at least one illuminating element (9) positioned inside the channel, a transparent covering element (14) inserted in a housing formed by the profile (8) close to an upper opening, by means of two undercuts (16) inside the profile (8), wherein one of the side walls (15) of the profile (8) comprises coupling means for fixing the profile (8) to a fastening flap (2 or 3) of an expansion joint designed to connect two structural elements (4, 5) separated by a space (6), the profile (8) being connectable to the expansion joint outside the space (6), wherein said at least one side wall (15) has a protrusion (17) elongated longitudinally, slidably insertable in a corresponding longitudinal groove (18) of a side wall of the fastening flap (2, 3), and wherein said side wall (15) has a flat outer face extending between the protrusion (17) and an upper end of the side wall (15) adjacent to the upper opening of the profile (8), wherein the protrusion (17) projects laterally in cantilever fashion from said flat outer face of the side wall (15) and defines a maximum lateral size of the profile (8), wherein said side wall (15) has a rib projecting from the side wall (15) in cantilever fashion towards the inside of the profile, to define one of said undercuts (16).

10. A method for mounting an expansion joint (1) for building works, comprising the steps of:

rigidly connecting a first and second fastening flap (2, 3) to a corresponding first and second structural element (4, 5) separated by a space (6), the fastening flaps (2, 3) and the space being (6) elongated in a longitudinal direction;

interconnecting the fastening flaps (2, 3) by an elastic connector (7) interposed and positioned in the space (6) to allow a relative movement of the structural elements (4, 5); and fastening to at least one of the fastening flaps (2, 3), from the side opposite the elastic connector (7), a profile (8) forming a channel elongated in the longitudinal direction and containing at least one illuminating element (9).

11. The method according to claim 10, wherein:

the fastening comprises a fitting of portions shaped to match of a side wall (15) of the profile (8) and a corresponding side wall of the fastening flap (2, 3).

12. The method according to claim 10, further comprising:

a step for filling with epoxy resin a defined area between the profile (8) and a wall (19) of the fastening flap (2 or 3) positioned transversely to another wall (20) of the fastening flap (2 or 3) hooked to the profile (8).

* * * * *